US008137144B1

(12) United States Patent
Wang

(10) Patent No.: US 8,137,144 B1
(45) Date of Patent: Mar. 20, 2012

(54) PIN CONNECTOR

(75) Inventor: Ching-Chao Wang, Lu Chu-Hsiang (TW)

(73) Assignee: E-Full Enterprise Co., Ltd., Lu Chu Hsiang, Taoyuan County (TW)

( * ) Notice: Subject to any disclaimer, the term of this patent is extended or adjusted under 35 U.S.C. 154(b) by 0 days.

(21) Appl. No.: 13/025,527

(22) Filed: Feb. 11, 2011

(51) Int. Cl.
*H01R 13/187* (2006.01)

(52) U.S. Cl. ..... 439/844; 439/78; 439/816; 439/867

(58) Field of Classification Search ..... 439/45, 439/78, 816, 844, 867
See application file for complete search history.

(56) References Cited

U.S. PATENT DOCUMENTS 3,218,606 A * 11/1965 Schultz ..... 439/844
3,222,632 A * 12/1965 Fuller ..... 439/844
3,383,648 A * 5/1968 Tems ..... 439/844
3,784,965 A * 1/1974 Murphy ..... 439/844
3,803,537 A * 4/1974 Cobaugh et al. ..... 439/844
3,922,057 A * 11/1975 Lemke et al. ..... 439/844
4,534,603 A * 8/1985 Brown et al. ..... 439/82
4,822,288 A * 4/1989 Conley ..... 439/84
4,981,450 A * 1/1991 Salvatore ..... 439/844
5,653,601 A * 8/1997 Martucci et al. ..... 439/82
7,621,756 B2 * 11/2009 Dittmann ..... 439/66

* cited by examiner

*Primary Examiner* — James Harvey
(74) *Attorney, Agent, or Firm* — Jeffrey D. Myers; Peacock Myers, P.C.

(57) ABSTRACT

A pin connector includes: a metal outer shell having a tubular wall that has an inner surface, an annular shoulder face that is formed on the inner surface, and a punched rib that protrudes inwardly from the inner surface above the annular shoulder face; and a metal clamping device having an annular wall with an outer surface abutted against the inner surface, a retaining flange, and a plurality of resilient clamp arms. The retaining flange protrudes outwardly from the outer surface of the annular wall to extend over the annular shoulder face and is pressed by the punched rib against the annular shoulder face.

2 Claims, 6 Drawing Sheets

PIN CONNECTOR

BACKGROUND OF THE INVENTION

1. Field of the Invention

This invention relates to a pin connector, more particularly to a pin connector mountable on a circuit board for connecting a conductor pin to the circuit board.

2. Description of the Related Art

A conventional pin connector 1 shown in FIG. 1 is mountable on a first electronic element (i.e., a printed circuit board 100) for detachably and electrically connecting a conductor pin 200 of a second electronic element (not shown) to the printed circuit board 100. In FIG. 1, the conductor pin 200 is not completely inserted into the pin connector 1. The pin connector 1 includes an outer shell 11 and a clamping device 12 inserted fittingly into the outer shell 11.

The outer shell 11 is substantially formed in a tubular shape and is adapted to be inserted into a hole of the printed circuit board 100. Moreover, the outer shell 11 includes a tubular wall 112, an outer flange 111 extending outwardly from an outer surface of the tubular wall 112 and adapted to abut against a top face of the printed circuit board 100, and a barb 113 protruding outwardly from the outer surface of the tubular wall 112 below the outer flange 111 and adapted to abut against a bottom face of the printed circuit board 100.

The clamping device 12 includes an annular wall 121 inserted fittingly into the tubular wall 112 of the outer shell 11, and a plurality of resilient clamp arms 122 connected to and tapering downwardly from a lower end of the annular wall 121. When the conductor pin 200 is inserted into the pin connector 1, the resilient clamp arms 122 clamp the conductor pin 200 so that the second electronic element is electrically connected to the printed circuit board 100 through the pin connector 1 and that a subsequent operation can be conducted, for example, measuring electrical signals.

Although the connector pin 200 can be detachably inserted into and electrically connected with the pin connector 1, the outer shell 11 and the clamping device 12 of the pin connector 1 are only engaged with each other by inserting fittingly the annular wall 121 of the clamping device 12 into the tubular wall 112 of the outer shell 11. Accordingly, after repeated insertion and detachment of the connector pin 200, the clamping device 12 eventually tends to loosen and slip off from the outer shell 11, and electrical connection of the second electronic element to the printed circuit board 100 will be adversely affected.

Another pin connector 2 as shown in FIG. 2 was developed by modifying the structure of the above pin connector 1 in combination with bending and pressing procedures. The pin connector 2 includes an outer shell 21 and a clamping device 22 inserted fittingly into the outer shell 21.

The outer shell 21 includes a tubular wall 212, a folded end portion 211, and a barb 213, and differs from the outer shell 11 of the pin connector 1 in that the outer flange 111 of the outer shell 11 is replaced by the folded end portion 211. The folded end portion 211 is adapted to be disposed above the top face of the printed circuit board 100, and has an inclined part 214 extending outwardly from an upper open end of the tubular wall 212, and a folded part 215 extending from the inclined part 214 and folded toward an interior of the tubular wall 212.

The clamping device 22 includes an annular wall 221, an inclined flange 222, and a plurality of resilient clamp arms 223, and differs from the clamping device 12 of the pin connector 1 in that the clamping device 22 further includes the inclined flange 222. The inclined flange 222 extends from an upper end of the annular wall 221, along the inclined part 214, and into a groove formed by the folded part 215.

Although the clamping device 22 can be prevented from sliding outwardly by receiving a part of the inclined flange 222 into the groove of the folded part 215, the clamping device 22 is inevitably likely to slide inwardly with the insertion of the connector pin 200. Hence, although the pin connector 2 is produced by a relatively complex process at a relatively high cost, the problem of poor electrical connection of the second electronic element to the printed circuit board 100 caused by sliding of the clamping device 22 with respect to the outer shell 21 still remains unsolved.

SUMMARY OF THE INVENT ION

Therefore, an object of the present invention is to provide a pin connector that can overcome the aforesaid drawbacks associated with the prior art.

Accordingly, a pin connector of the present invention is mountable on a circuit board for connecting a conductor pin to the circuit board, and comprises:

a metal outer shell adapted to be inserted into a hole of the circuit board, and including a tubular wall that has an upper open end and an inner surface defining a receiving space, an outer flange protruding outwardly from an outer surface of the tubular wall and adapted to abut against a top face of the circuit board, a barb protruding outwardly from the outer surface of the tubular wall below the outer flange and adapted to abut against a bottom face of the circuit board, an annular shoulder face that is formed on the inner surface of the tubular wall to face upwardly toward the upper open end and that extends solely in radial directions at a level higher than that of the barb, and a punched rib that protrudes inwardly from the inner surface of the tubular wall above the annular shoulder face; and a metal clamping device inserted fittingly into the receiving space, and including an annular wall with an outer surface abutted against the inner surface of the tubular wall, a retaining flange that protrudes outwardly from the outer surface of the annular wall to extend over the annular shoulder face and that is pressed by the punched rib against the annular shoulder face, and a plurality of resilient clamp arms adapted to clamp the conductor pin, the resilient clamp arms being connected to and tapering downwardly from a lower end of the annular wall.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
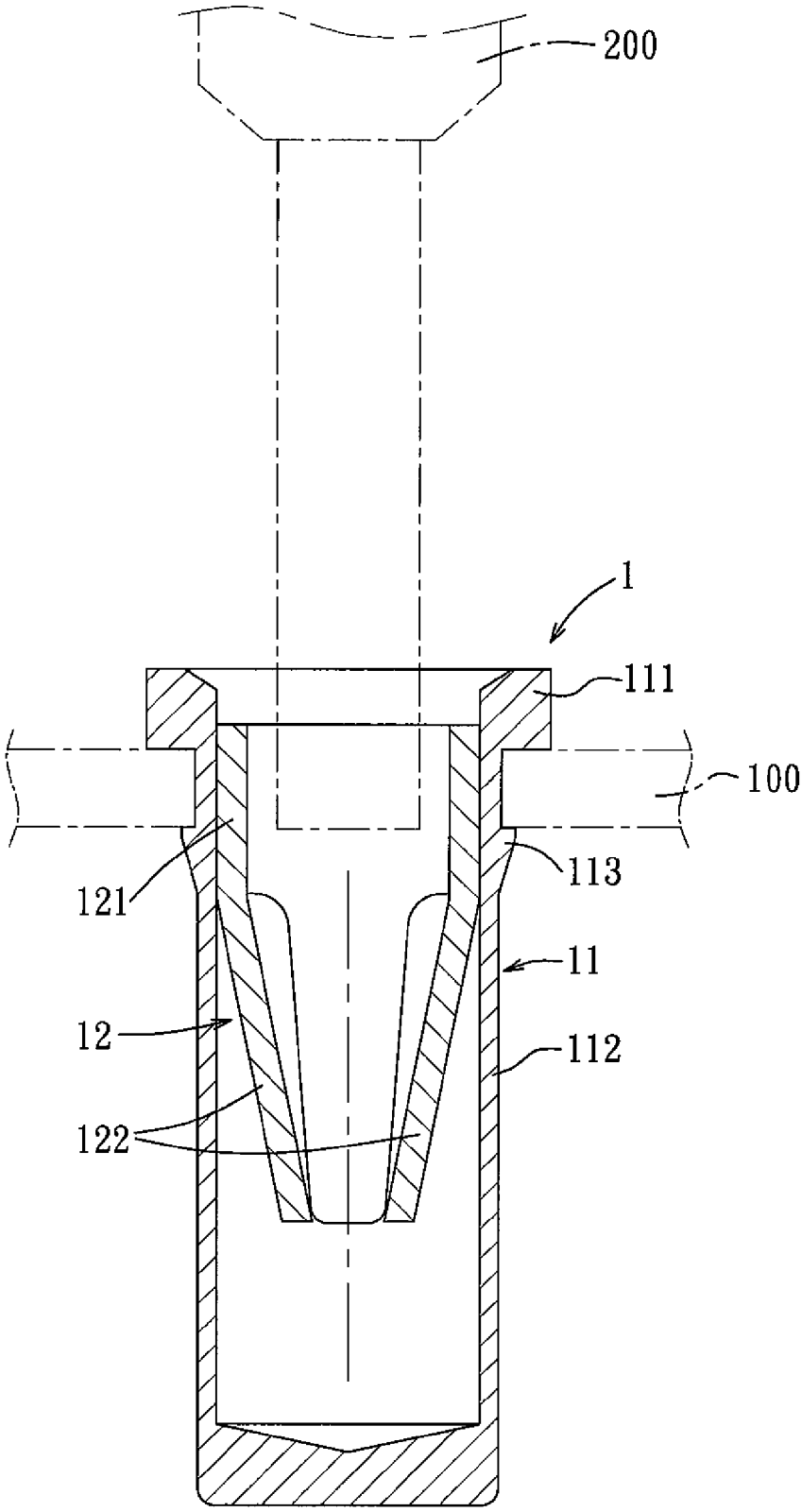
FIG. 1 PRIOR ART
FIG. 1 is a cross-sectional view of a conventional pin connector.
Figure 2:
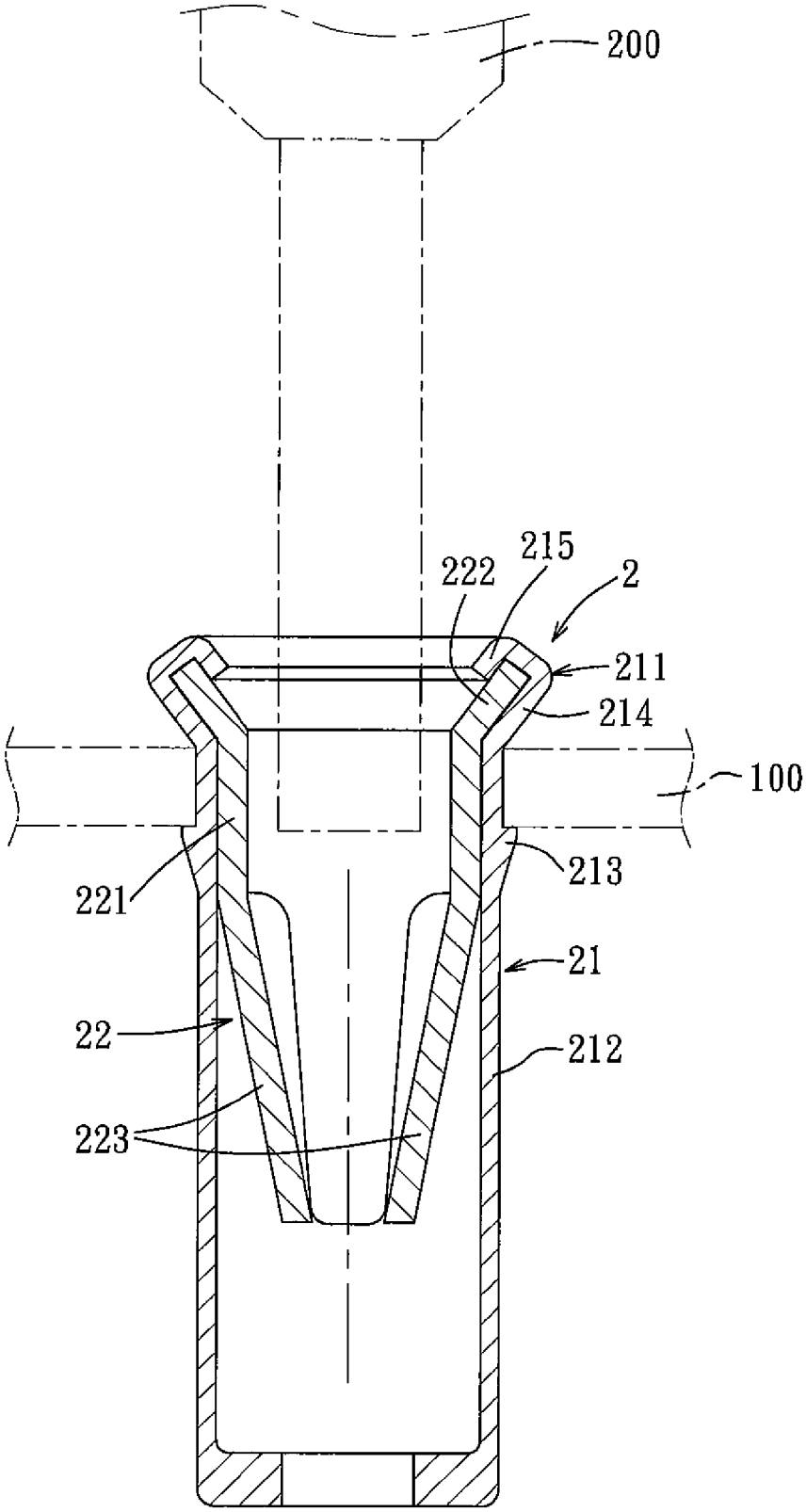
FIG. 2 PRIOR ART
FIG. 2 is a cross-sectional view of another conventional pin connector.

Before the present invention is described in greater detail with reference to the accompanying preferred embodiments, it should be noted herein that like elements are denoted by the same reference numerals throughout the disclosure.

Figure 3:
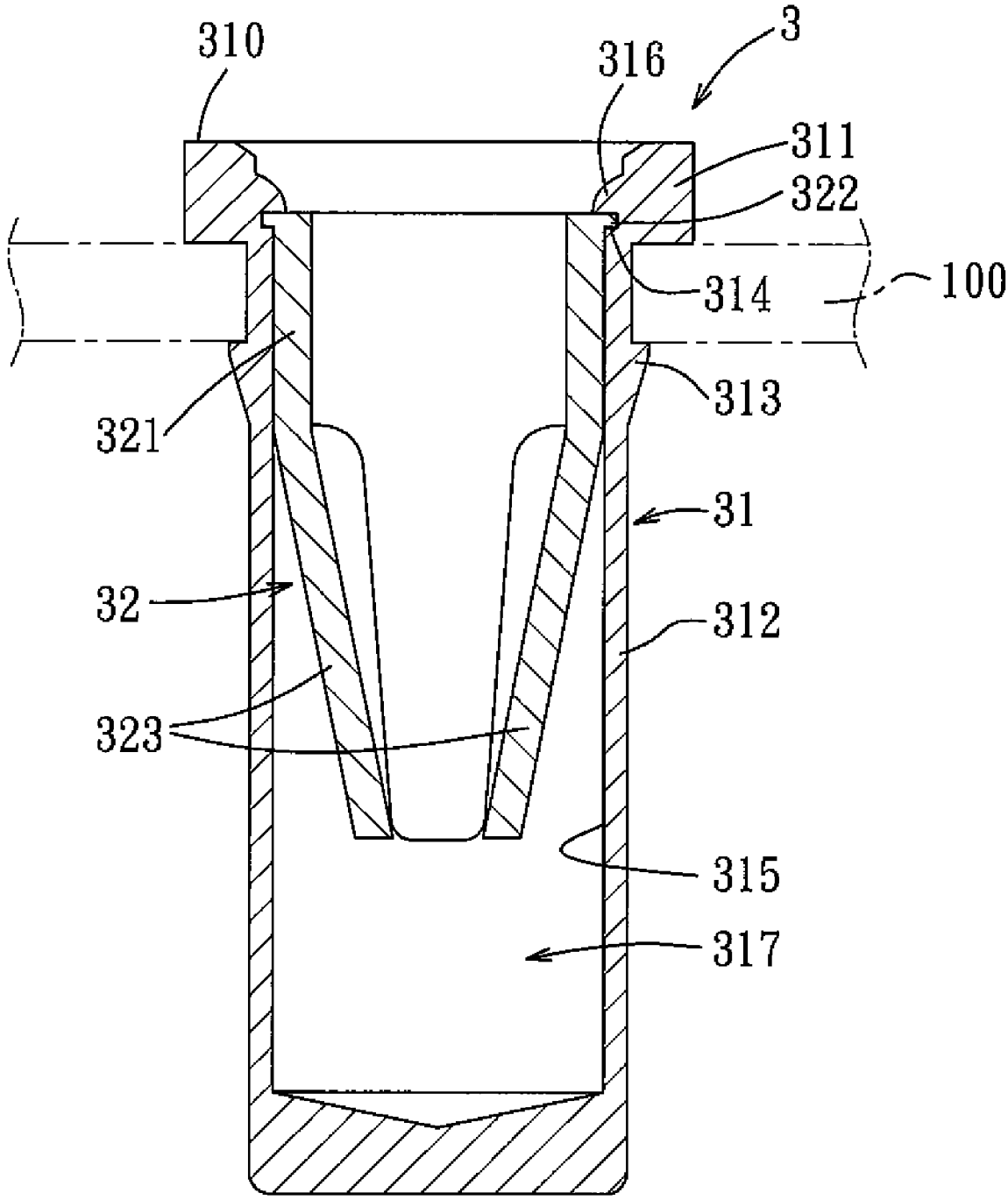
FIG. 3 is a cross-sectional view of the first preferred embodiment of a pin connector according to the present invention.
Figure 4:
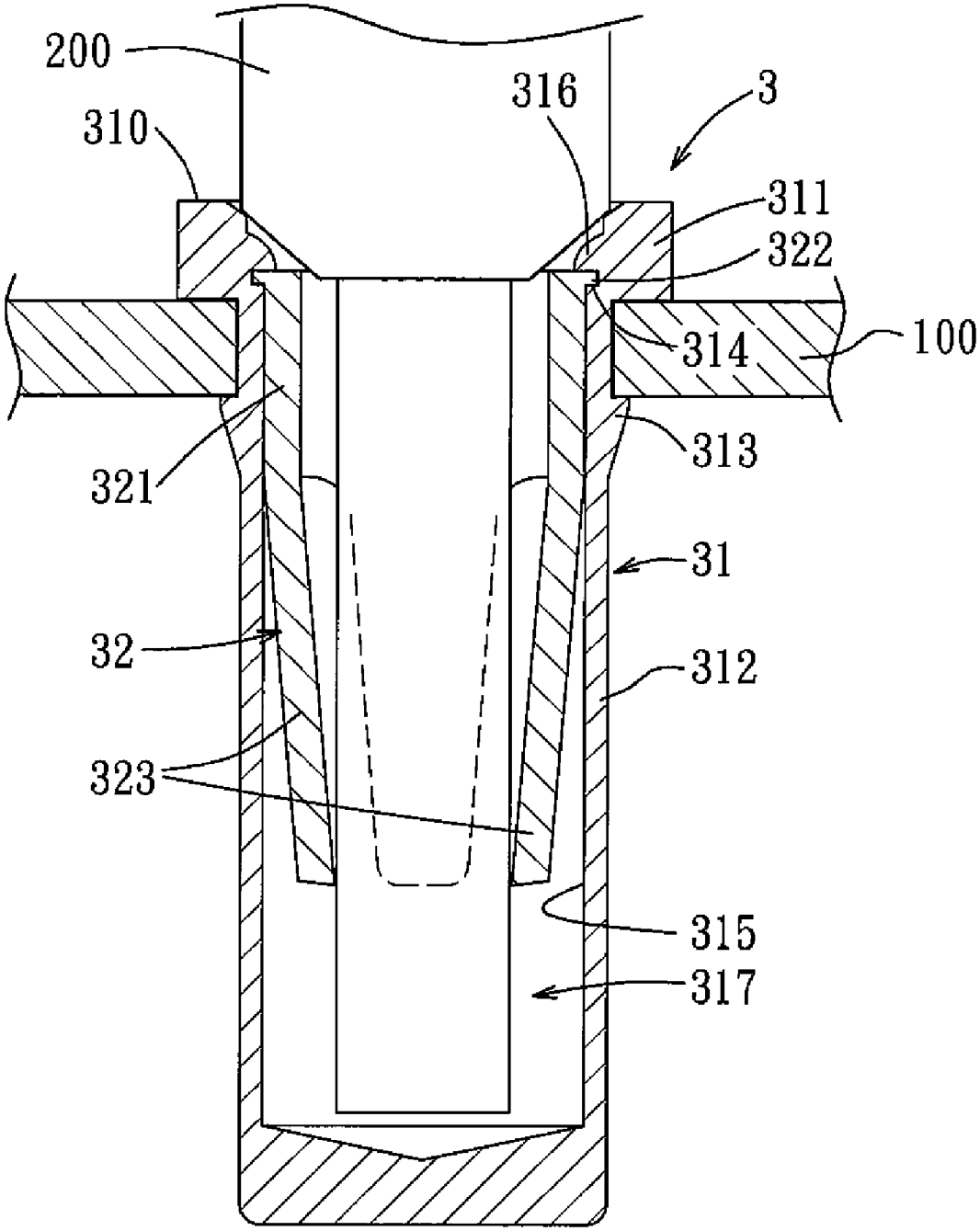
FIG. 4 is a cross-sectional view of the first preferred embodiment of FIG. 3 in a state of use.

Referring to FIGS. 3 and 4, the first preferred embodiment of a pin connector 3 of the present invention is mountable on a first electronic element 100 for detachably and electrically connecting a conductor pin 200 of a second electronic element (not shown) to the first electronic element 100. In this preferred embodiment, the first electronic element 100 is a printed circuit board.

The pin connector 3 includes a metal outer shell 31 plated with bright tin, and a metal clamping device 32 mainly made of a beryllium copper alloy and plated with gold.

The metal outer shell 31 may be substantially formed in a tubular shape, is adapted to be inserted into a hole of the printed circuit board 100, and includes a tubular wall 312, an outer flange 311, a barb 313, an annular shoulder face 314, and a punched rib 316. In the preferred embodiment, the metal outer shell 31 includes only one opening for insertion of the conductor pin 200.

The tubular wall 312 has an upper open end 310 defining the opening of the metal outer shell 31 and an inner surface 315 defining a receiving space 317. The outer flange 311 protrudes outwardly from an outer surface of the tubular wall 312 and is adapted to abut against a top face of the printed circuit board 100. The barb 313 protrudes outwardly from the outer surface of the tubular wall 312 below the outer flange 311 and is adapted to abut against a bottom face of the printed circuit board 100. The annular shoulder face 314 is formed on the inner surface 315 of the tubular wall 312 to face upwardly toward the upper open end 310 and extends solely in radial directions at a level higher than that of the barb 313. The punched rib 316 protrudes inwardly from the inner surface 315 of the tubular wall 312 above the annular shoulder face 314.

The metal clamping device 32 is inserted fittingly into the receiving space 317, and includes an annular wall 321, a retaining flange 322, and a plurality of resilient clamp arms 323.

The annular wall 321 has an outer surface abutted against the inner surface 315 of the tubular wall 312. The retaining flange 322 protrudes outwardly from the outer surface of the annular wall 321 to extend over the annular shoulder face 314 and is pressed by the punched rib 316 against the annular shoulder face 314. The resilient clamp arms 323 are adapted to clamp the conductor pin 200, and are connected to and taper downwardly from a lower end of the annular wall 321. In the preferred embodiment, the annular wall 321 and the retaining flange 322 are substantially perpendicular to each other.

Preferably, the retaining flange 322 and the punched rib 314 are annular.

As shown in FIG. 4, when the conductor pin 200 is inserted into the pin connector 3 of this invention, the resilient clamp arms 323 are pressed to expand for insertion of the conductor pin 200 into the receiving space 317 and to clamp the conductor pin 200. Accordingly, the second electronic element is electrically connected to the printed circuit board 100 through the pin connector 3 for conducting a subsequent process, for example, an electric signal measuring process.

Since the metal clamping device 32 is inserted fittingly into the metal outer shell 31, and since the metal clamping device 32 is further fixed to the metal outer shell 31 by retaining the retaining flange 322 of the metal clamping device 32 between the punched rib 316 and the annular shoulder face 314 of the metal outer shell 31, sliding of the metal clamping device 32 relative to the metal outer shell 31 can be prevented.

Figure 5:
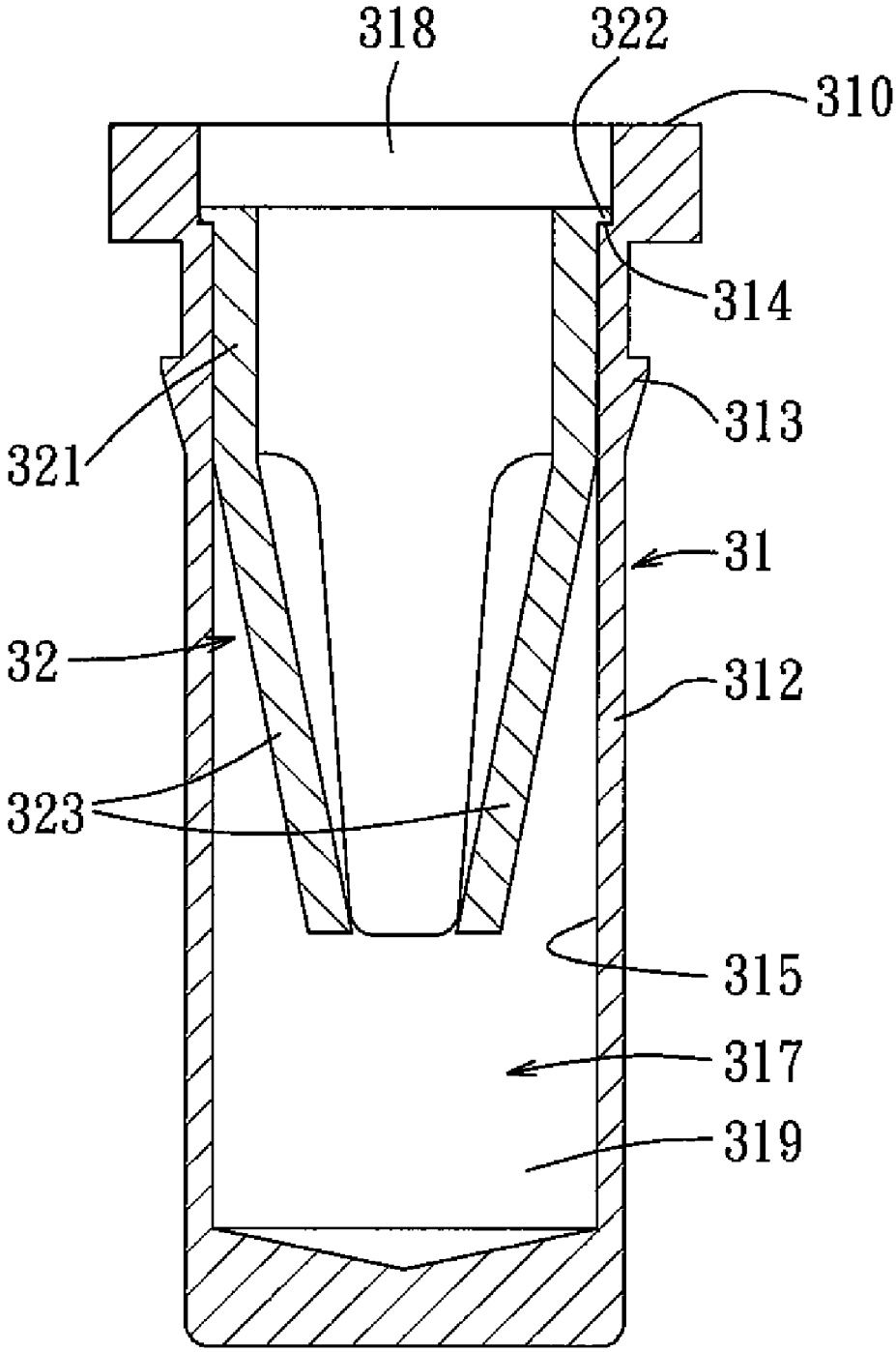
FIG. 5 is a cross-sectional view to illustrate formation of a retaining flange that rests on an annular shoulder face by using a punching process according to the preferred embodiment of a method for making a pin connector of the present invention.

The pin connector 3 of this invention will be described in more detail below in connection with a method for making the same. The method includes the following steps:

(a) providing a metal outer shell 31 including a tubular wall 312 that has an upper open end 310 and an inner surface 315 defining a receiving space 317 that extends downwardly from the upper open end 310, the receiving space 317 having a large width hole portion 318 proximate to the upper open end 310, and a small width hole portion 319 distal from the upper open end 310, the inner surface 315 of the tubular wall 312 having an annular shoulder face 314 that faces upwardly toward the upper open end 310 at a junction of the large and small width hole portions 318, 319 (see FIG. 5);

(b) providing a metal clamping device 32 including an annular wall 321, a retaining flange 322 protruding from an outer surface of the annular wall 321 adjacent to an upper end of the annular wall 321, and a plurality of resilient clamp arms 323 connected to and tapering downwardly from a lower end of the annular wall 321;

(c) inserting the annular wall 321 and the resilient clamp arms 323 into the tubular wall 312 of the metal outer shell 31 through the upper open end 310 of the metal outer shell 31 until the retaining flange 322 rests on the annular shoulder face 314 (see FIG. 5); and (d) punching the tubular wall 312 through the upper open end 310 thereof so that a part of the tubular wall 312 deforms and protrudes inwardly from the inner surface 315 of the tubular wall 312 to form a punched rib 316 as shown in FIGS. 3 and 4 above the retaining flange 322 to press the retaining flange 322 against the annular shoulder face 314.

Preferably, in the step (c), the annular wall 321 and the resilient clamp arms 323 are inserted into the tubular wall 312 of the metal outer shell 31 using a punching process.

By the method according to the present invention, the pin connector 3 can be easily made at a relatively low cost.

Figure 6:
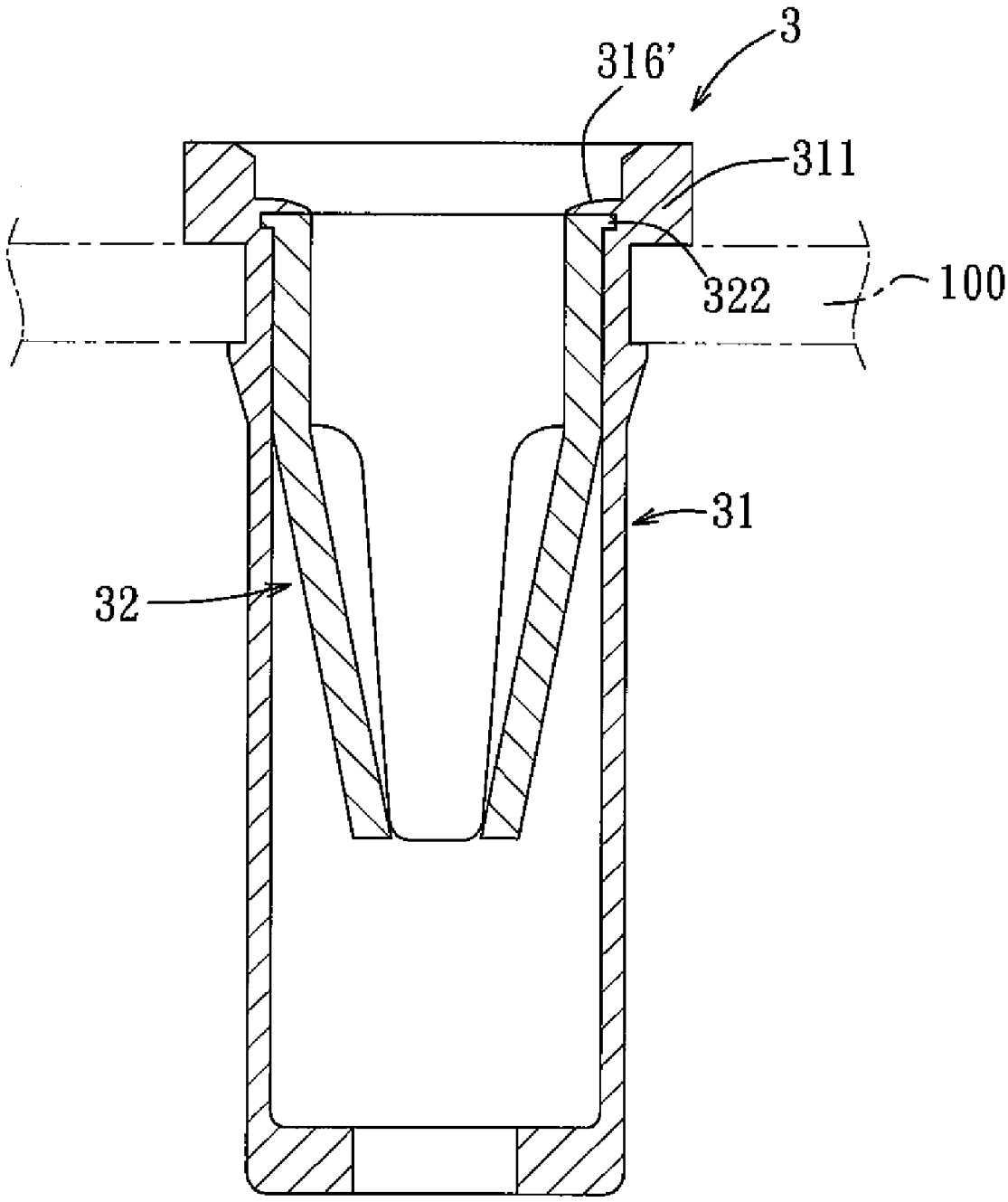
FIG. 6 is a cross-sectional view of the second preferred embodiment of a pin connector according to the present invention.

FIG. 6 illustrates the second preferred embodiment of the pin connector 3 of this invention. The punched rib 316' of the second preferred embodiment is formed by further punching the punched rib 316 of the first preferred embodiment (see FIG. 3) so that the punched rib 316' substantially covers an upper surface of the retaining flange 322. Accordingly, in the second preferred embodiment, the metal clamping device 32 is more firmly fixed to the metal outer shell 31. The effect of preventing the metal clamping device 32 from sliding relative to the metal outer shell 31 can be enhanced.

Besides, in this embodiment, in addition to the opening surrounded by the outer flange 311 of the metal outer shell 31, another opening for extension of the conductor pin 200 is formed in a bottom portion of the metal outer shell 31 opposite to the outer flange 311. Therefore, when the conductor pin 200 has a relatively long length, the pin connector 3 of the second preferred embodiment can be selected to use.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A pin connector mountable on a circuit board for connecting a conductor pin to the circuit board, said pin connector comprising:

a metal outer shell adapted to be inserted into a hole of the circuit board, and including a tubular wall that has an upper open end and an inner surface defining a receiving space, an outer flange protruding outwardly from an outer surface of said tubular wall and adapted to abut against a top face of the circuit board, a barb protruding outwardly from said outer surface of said tubular wall below said outer flange and adapted to abut against a bottom face of the circuit board, an annular shoulder face that is formed on said inner surface of said tubular wall to face upwardly toward said upper open end and that extends solely in radial directions at a level higher than that of said barb, and a punched rib that protrudes inwardly from said inner surface of said tubular wall above said annular shoulder face; and a metal clamping device inserted fittingly into said receiving space, and including an annular wall with an outer surface abutted against said inner surface of said tubular wall, a retaining flange that protrudes outwardly from said outer surface of said annular wall to extend over said annular shoulder face and that is pressed by said punched rib against said annular shoulder face, and a plurality of resilient clamp arms adapted to clamp the conductor pin, said resilient clamp arms being connected to and tapering downwardly from a lower end of said annular wall.

2. The pin connector of claim 1, wherein said retaining flange and said punched rib are annular.

* * * * *